US005591057A

United States Patent [19]

Dai et al.

[11] Patent Number: 5,591,057

[45] Date of Patent: Jan. 7, 1997

[54] HULL SUPPORTED STEERING AND REVERSING GEAR FOR LARGE WATERJETS

[75] Inventors: Charles M. Dai, Potomac; John L. Allison, Severna Park, both of Md.

[73] Assignee: The United States of America as represented by the Secretary of the Navy, Washington, D.C.

[21] Appl. No.: 527,994

[22] Filed: Sep. 14, 1995

Related U.S. Application Data

[63] Continuation-in-part of Ser. No. 313,612, Sep. 30, 1994, abandoned, which is a continuation-in-part of Ser. No. 314,301, Sep. 30, 1994, Pat. No. 5,476,401.

[51] Int. Cl.[6] ..... B63H 11/113; B63H 11/117

[52] U.S. Cl. ..... 440/42; 440/43

[58] Field of Search ..... 440/40, 42, 43; 114/166, 163; 60/221, 222

[56] References Cited

U.S. PATENT DOCUMENTS

| | | | |
|---|---|---|---|
| 3,127,741 | 4/1964 | Pottharst, Jr. | 440/43 |
| 3,478,712 | 11/1969 | Fox | 440/43 |
| 3,807,346 | 4/1974 | Delfeld | 440/42 |
| 4,538,997 | 9/1985 | Haglund et al. | 440/43 |

FOREIGN PATENT DOCUMENTS

| | | | |
|---|---|---|---|
| 2-162192 | 6/1990 | Japan | 440/40 |
| 5-278683 | 10/1993 | Japan | 440/42 |
| 945224 | 12/1963 | United Kingdom | 440/43 |

OTHER PUBLICATIONS

"Water–jet Propulsion Unit", Mitsubishi Heavy Industries, Ltd., 1993.

Allison, John L. and Charles Dai,"Steering and Reversing Gear For Very Large Waterjets," International Symposium on Waterjet Propulsion—Latest Developments (Dec. 1 and 2, 1994), pp. 1–16.

*Primary Examiner*—Sherman Basinger

*Attorney, Agent, or Firm*—Gary G. Borda

[57] ABSTRACT

A waterjet propulsion system for a vessel permits stationary mounting of the pump within the vessel hull, and further allows minimizing the size and weight of the pump casing, by providing a pivotably moveable, hull mounted and supported, steering and reversing sleeve mechanism positioned to receive the waterjet flow from a waterjet nozzle and to redirect at least a portion of that flow for steering and production of reverse thrust. The sleeve structure also permits all machinery for achieving control of steering and reverse thrust to be placed in protected locations such as being faired into the sleeve or within the vessel hull. Protection of linkages and reduction of the weight thereof is also provided.

13 Claims, 3 Drawing Sheets

HULL SUPPORTED STEERING AND REVERSING GEAR FOR LARGE WATERJETS

CROSS REFERENCE TO RELATED APPLICATIONS

This application is a continuation-in-part of co-owned and copending application Ser. No. 08/313,612, filed Sep. 30, 1994, and now abandoned, and Ser. No. 08/314,301, filed Sep. 30, 1994 and now U.S. Pat. No. 5,476,401.

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention generally relates to the steering of waterjet propulsion systems and, more particularly, to a steering and reversing gear designed to be integral with a marine vessel hull, i.e., entirely independent of the waterjet pump and nozzle, and suitable for use with high-powered waterjet propulsion systems for large vessels.

2. Brief Description of Related Art

Early waterjet propulsor applications were particularly for use on small boats and recreational vehicles such as jet skis. Since about 1980, waterjet propulsors have become increasingly used with larger and larger vessels. As a result, the pumps and steering and reversing gear of large waterjet propulsion systems have become increasingly larger and have been exposed to increasingly larger stresses. The attachment of such large propulsion systems to large vessel must be relatively robust in order to carry thrust loads and to maintain hull integrity in the event of contact with underwater objects. Consequently, such applications of waterjet propulsion systems with large marine vehicles requires very large pump housings to withstand the applied loads. However, as the size and power of waterjet propulsors increase, the problems associated with the provision of steering and reversing gear increase in difficulty. In large part this is due to the familiar squared-cubed law, whereby masses, and hence weight and dynamic force, increase with the cube of the scale factor, whereas cross-sections available to resist these forces increase only with the square of the scale factor, while material properties remain the same.

The steering and reversing gear of known, commercially available waterjet propulsion systems are mounted to and supported by the pump and, thus, transmit large forces to the pump housing. For small and medium sized waterjets, this arrangement presents no particular problem. The pump body is robust for other reasons and only local strengthening is needed to take weight and hydrodynamic forces arising from steering and reversing gear. However, these forces are not small since they include the following: steering forces up to about half the maximum gross thrust; reverse forces up to about 1.5 times the maximum gross thrust; dynamic forces due to ship motions; wave loads due to slamming; impact loads during docking, etc.; and weight of the steering sleeve or nozzle, reversing bucket, actuators and entrained water. All these forces are reacted at the pump body attachment points and are transmitted into the hull through the pump mounts whether the pump is transom mounted or otherwise.

As the size of the waterjet is increased to accept higher powers, the material thickness must increase disproportionately since, as stated earlier, weights and forces tend to increase as the cubed of the scale factor while available material sections increase only as the square of the scale factor. However, increasing material thickness to hold down stresses results in more weight and higher dynamic forces associated with weight. A point is eventually reached where it is no longer possible to maintain maximum stresses within safe limits for materials of choice. The designer then has two options; use higher strength materials, which are costly, or consider a different design concept. It may not be sufficient to make the pump body stronger since its attachment to the hull must also be considered.

More recently, there has been an interest in applying waterjet propulsion to large Naval vessels, e.g., large sea-going displacement vessels such as Naval Destroyers, because of the efficiencies which may be achieved over more conventional propulsion systems. The U.S. Navy recently initiated a study to explore the application of waterjets to surface ships having a design speed of about 30 knots and requiring twin propulsors with power in the range of 50,000 hp (37 mW) per propulsor. However, such arrangements are not easily scaled to sizes usable in larger sea-going vessels. With a proposed nozzle equivalent diameter approaching 3 meters, the size and weight of a conventional steering and reversing gear are impractical for attachment to the pump body. In addition to disproportionate increases in strengthening the mounting structure to carry increased thrust loads, the control linkages for rotating the waterjet propulsor must be greatly enlarged. Even in the case of waterjet propulsors for small craft, control linkages are a significant portion of the weight of the entire propulsion system. With larger propulsors the weight becomes a much larger fraction of the total weight of the system.

Further, the control linkages would also be outside the vessel and constitute a much more serious source of drag and are far more vulnerable to damage. The manipulation of such large structures would be accomplished hydraulically and damage to a hydraulic hose or other damage could easily disable a larger vessel, leaving at most, only differential thrust from propulsors displaced from the vessel centerline for steering and maneuvering the vessel. Stresses in the control linkages and bearings would also become very high in large waterjet propulsion systems and could lead to fatigue and failure.

Additionally, reverse thrust presents special problems as waterjet propulsion systems are made larger. Specifically, while the entire waterjet propulsor may be rotated 180° to obtain reverse thrust on a small propulsor, this cannot readily be done with a large system. For this reason, on large waterjet systems where the pump is inside the hull, steering is generally accomplished with a conventional steering sleeve or nozzle attached to and supported by the pump. Reverse thrust is obtained with a conventional reversing bucket integral with the steering sleeve.

In summary, in available designs, all loads on the steering and reversing mechanisms, and other parts of the propulsion system due to motion of the vessel as well and thrust forces, are transmitted to the vessel through the propulsor pump. Known mechanisms for producing reverse thrust are also required to be sufficiently robust so that, for a large vessel, the weight thereof represents a significant source of inefficiency. To date, no mechanical system for accomplishing steering, braking and reversing in large waterjet propulsion systems, i.e., propulsors having power greater than about 27,000 hp (20 mW), has been proposed which acts independent of the waterjet propulsor, e.g., is mounted entirely independent of the pump, in order to minimize transferred loads on the propulsion system. Thus, there is a need for a steering and reversing gear that overcomes the problems associated with pump supported steering and reversing gear to be installed on large vessels such as Naval Destroyers.

SUMMARY OF THE INVENTION

It is therefore an object of the present invention to provide a vessel with a waterjet propulsion system in which the steering and reversing gear are structurally independent of the waterjet pump and nozzle and are fully integrated with the ship hull.

It is another object of the invention to provide steering and reversing mechanisms for a waterjet propulsion system in which forces thereon are not reacted through the pump of the waterjet propulsor.

It is a further object of the invention to provide a waterjet propulsion system suitable for a large vessel, such as for example, Naval Destroyers, and which provides an alternative to the use of a reversing bucket in order to obtain reverse thrust.

It is yet another object of the invention to provide a structure for producing reverse thrust which is subjected only to forces of the waterjet and which is located in a manner to be largely protected from physical damage.

It is another further object of the invention to provide a waterjet propulsion system suitable for large vessels in which the steering actuation machinery are entirely within the hull and in which steering linkages are substantially within the hull.

It is yet another further object of the invention to provide a waterjet propulsion system in which reverse thrust is fully steerable.

In order to accomplish these and other objects of the invention, an apparatus for receiving flow discharged from a fixed nozzle of a high power waterjet propulsion system is provided. The nozzle directs the flow in a generally aft direction for propelling a vessel through water. The apparatus redirects the flow received from the nozzle for providing maneuvering capability to the vessel. The apparatus comprises a hollow steering sleeve defining a flow passage and at least one reversing vane pivotably mounted to the sleeve and positioned entirely within the flow passage. The sleeve is adapted to be pivotably mounted about a substantially vertical axis directly to the stern of the vessel independent of the nozzle. The flow passage includes an inlet with an internal dimension equal to or greater than an internal dimension of the nozzle and a rearwardly facing outlet. The flow passage is in axial alignment with the nozzle to receive at least a major portion of the flow subsequent to the flow exiting the nozzle. The reversing vane is pivotal between a first substantially horizontal position wherein the reversing vane functions as at least a portion of a bottom surface of the flow passage, and a second position wherein the reversing vane closes the rearwardly facing outlet and defines an aperture in the bottom surface of the flow passage, the flow being deflected by the reversing vane to an exterior of the sleeve through the aperture. Thus, the apparatus acts independently of the nozzle to redirect the flow received from the nozzle such that forces acting on the apparatus are transmitted directly to the vessel with none of the forces being transmitted to the waterjet propulsion system. The apparatus may further include a plurality of stationary curved vanes, the curved vanes rigidly mounted laterally to and integral with the steering sleeve so as to be stationary relative to the sleeve, the curved vanes positioned below the reversing vane for receiving flow deflected by the reversing vane through the aperture and redirecting the flow in a generally downward and forward direction.

In accordance with another aspect of the invention, a high power waterjet propulsion system for propelling a large ocean-going vessel is provided. The waterjet propulsion system includes a pump means mounted in a stationary fashion within the vessel for providing a waterjet flow, a nozzle rigidly mounted to and penetrating the stern of the vessel, the nozzle in flow communication with the pump means for discharging the flow to an exterior of the vessel, a hollow steering sleeve defining a flow passage, and at least one reversing vane pivotably mounted to the sleeve and positioned entirely within the flow passage. The steering sleeve is adapted to be pivotably mounted about a substantially vertical axis directly to the stern of the vessel independent of the nozzle. The flow passage has an inlet with an internal dimension equal to or greater than an internal dimension of the nozzle and a rearwardly facing outlet. The flow passage, from inlet to outlet, is in axial alignment with the nozzle to receive at least a major portion of the flow subsequent to the flow being discharged from the nozzle. The internal reversing vane pivots between a first substantially horizontal position wherein the reversing vane functions as at least a portion of a bottom surface of the flow passage, and a second position wherein the reversing vane closes the rearwardly facing outlet and defines an aperture in the bottom surface of the flow passage, the flow being deflected by the reversing vane to an exterior of the sleeve through the aperture.

In accordance with a further aspect of the invention, a vessel having a high power waterjet propulsion system is provided. The vessel includes a hull means for traveling on water, at least one pump means mounted in a stationary fashion within the hull means for providing a waterjet flow for propelling the hull means through water, at least one nozzle, and at least one hollow steering sleeve having a reversing vane therein. Each nozzle is associated with a corresponding one of the pump means. Each nozzle is rigidly mounted to the hull means, penetrates the hull means at or adjacent to the stern of the hull means, and is in flow communication with the corresponding pump means for discharging the flow to the exterior of the hull means. Each steering sleeve is associated with a corresponding one of the nozzles. Each steering sleeve defines a flow passage having an inlet with an internal dimension equal to or greater than an internal dimension of the corresponding nozzle and having a rearwardly facing outlet. Each flow passage is in axial alignment with the corresponding nozzle to receive at least a major portion of the flow subsequent to the flow being discharged from the corresponding nozzle. Each steering sleeve is adapted to be pivotably mounted about a substantially vertical axis directly to the stern of the hull means independent of the corresponding nozzle. Each reversing vane is associated with a corresponding one of the steering sleeves. Each reversing vane is pivotably mounted to the corresponding steering sleeve and is positioned entirely within the flow passage. Each reversing vane pivots between a first substantially horizontal position wherein the reversing vane functions as at least a portion of a bottom surface of the flow passage, and a second position wherein the reversing vane closes the rearwardly facing outlet and defines an aperture in the bottom surface of the flow passage, the flow being deflected by each the reversing vane to the exterior of the corresponding sleeve through the aperture.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENT

Figure 1:
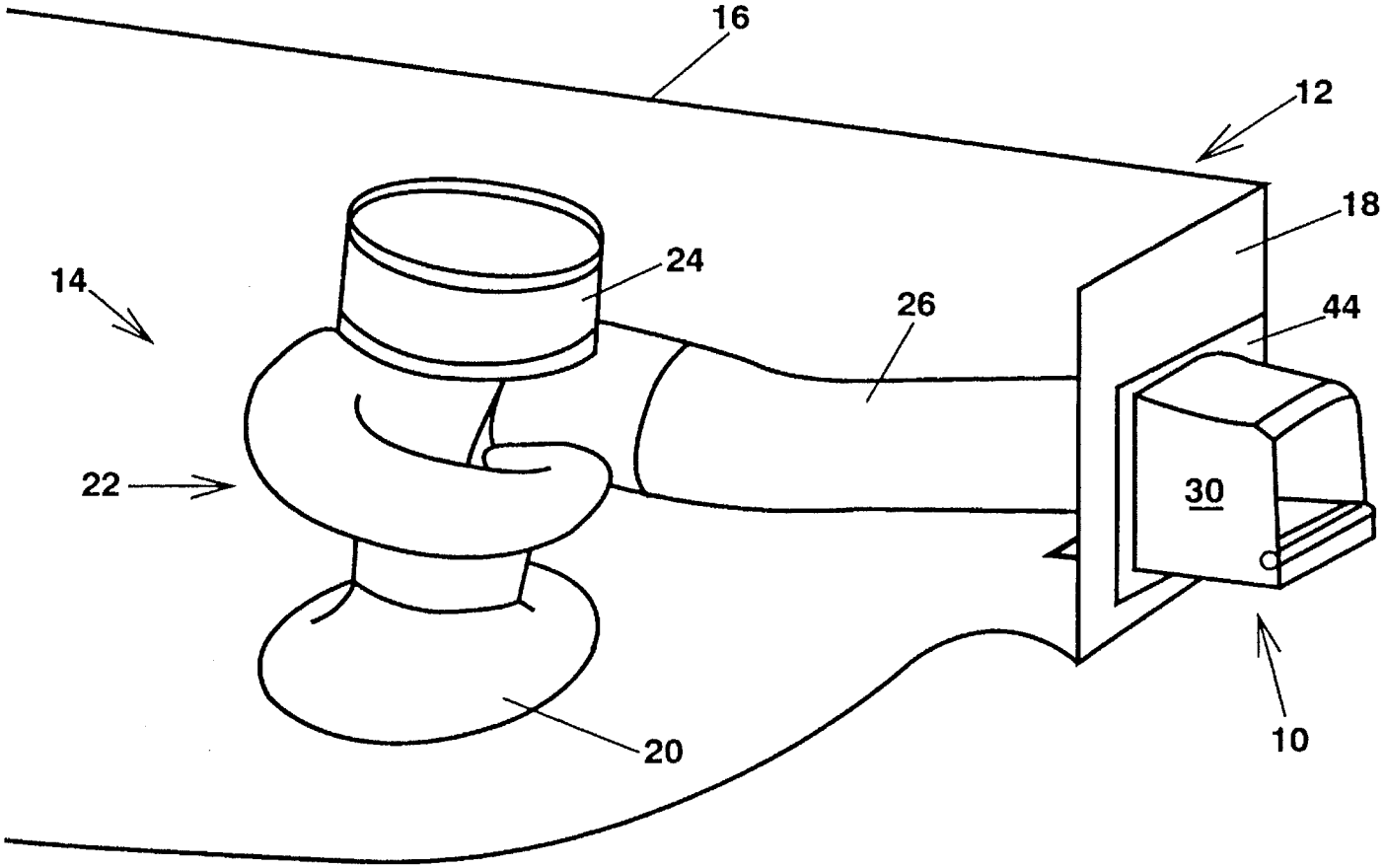
FIG. 1 is a perspective view showing the waterjet propulsion system of the present invention mounted in a marine vehicle.

Although the present invention is well suited for use on any large marine vehicle that employs very high power waterjet propulsion, i.e., individual waterjet propulsors having power greater than about 27,000 hp (20 mW), the present invention is envisioned for use with the waterjet propulsion system disclosed in U.S. patent application Ser. No. 08/314,301, filed Sep. 30, 1994, now U.S. Pat. No. 5,476,401, incorporated herein by reference. In the above mentioned patent application, an improved waterjet propulsion system for a marine vehicle is provided. Due to practical sizes of engines and pumps, two or more propulsors would generally be dictated for use in larger, sea-going vessels. For the particular Naval ship application, a Naval Destroyer, two waterjet propulsors, one on the port side and one on the starboard side of the ship, are proposed. However, the present invention is applicable to ship designs requiring a single waterjet or three or more waterjets. Generally, for three or more waterjets only the outer two waterjets would need to be fitted with the steering and reversing gear of the present invention.

Generally, the steering and reversing gear of the present invention is mounted to the hull at the transom or, preferably, in transom cut-outs at or near the waterline. The steering sleeve can be operated by a conventional rudder actuator mounted within the hull above the steering sleeve vertical pivot axis, in much the same way as a rudder. The waterjet pump is mounted entirely within the hull and has no direct connection with the steering and reversing gear. Thus, the pump body does not have to withstand any added forces besides its own internal hydrodynamic forces and their reaction on the hull. The nozzle of the waterjet propulsion system discharges accelerated flow through an aperture in the transom or forward bulkhead of the hull cut-out. The aperture is fitted with a flexible seal to prevent water ingress around the nozzle body and into the pump compartment when the transom is wetted or the cut-out is flooded. Wave action can cause flooding of the cut-out space when the ship is not underway. Once the ship is underway, the cut-out will drain so that the jet discharges into the air just above the water surface.

For the particular Naval ship application, height available in the hull for installation of the steering and reversing gear was limited. Thus, a non-circular flow passage and a non-circular nozzle, substantially oval in section with the height being less than the width, were used. However, the present invention may be used with any shape of nozzle. The length of the sleeve is dictated, in part, by the necessity of the reverse flow to clear the bottom of the transom.

It is a basic characteristic of the invention that deflection of all or a portion of the waterjet discharge is achieved subsequent to the free waterjet stream leaving the waterjet outlet nozzle. The invention is adapted to be rotated to port and starboard relative to a longitudinal centerline of the marine vehicle hull for redirecting the waterjet stream laterally. The invention is mounted directly to the vessel hull, typically at the transom, and is positioned coaxially with and longitudinally separated from the nozzle, i.e., while in a neutral (non-rotated) position the invention is longitudinally aligned with and aft of the nozzle. Therefore, the pump and nozzle of the propulsion system need not be moved and the control system is greatly simplified and lightened. More importantly, forces acting on the structurally independent steering and reversing gear are transferred directly to the hull with no forces being transferred to the waterjet pump or nozzle. Thus, the pump housing need not be structurally reinforced to withstand the loads.

Referring now to the drawings, and particularly to FIG. 1, the steering and reversing gear 10 of present invention is shown installed in a marine vehicle hull 12. Waterjet propulsion system 14 is shown mounted in hull 12. Hull 12 may be a monohull, a planing or semi-planing craft, or any other marine vehicle suitable for use with waterjets. The outlines of hull 12 indicate how waterjet propulsion system 14 is located and oriented in aft portion 16 of hull 12. Aft portion 16 is generally that portion of hull 12 adjacent stern 18 (preferably a transom stern) and extending forward of stern 18 about one quarter of the vehicle length measured as at the waterline. The preferred structural elements of waterjet propulsion system 14 include inlet duct 20, pump 22, motor 24 having a short drive shaft located completely out of the water flow path, downstream flow duct 26 ending in an outlet nozzle 28 at or near hull transom 18 for receiving an accelerated flow from pump 22 and discharging it in a generally rearward direction, and hull mounted steering and reversing gear 10. Steering and reversing gear 10 of the present invention is pivotably mounted about a substantially vertical axis to aft portion 16 of hull 12, preferably at or just forward of transom stern 18, for redirecting accelerated flow received from outlet nozzle 28 to provide maneuvering capability to the vehicle. Steering and reversing gear 10 is hull mounted to be structurally independent of pump 22 and nozzle 28. In a preferred embodiment of waterjet propulsion system 14, a compact system having a reduced stacking height is provided wherein the central axes of inlet duct 20, pump 22, and the drive shaft of motor 24 are in substantially axial alignment.

Downstream flow duct 26 is connected at a first end to the outlet of pump 22 and includes outlet nozzle 28 at a second end thereof. Preferably nozzle 28 is mounted in aft portion 16 of hull 12 for discharging accelerated flow in a generally rearward direction through aperture 29 in hull 12. Outlet nozzle 28 may discharge accelerated flow from hull 12 either at, below or above the waterline. In a preferred embodiment, outlet nozzle 28 is located at or adjacent transom stern 18 at or just above the waterline.

In a preferred embodiment, steering and reversing gear 10, which receives flow from outlet nozzle 28, includes a steering sleeve 30, a reversing vane 32 pivotably mounted to sleeve 30 and a plurality of cascade vanes 34 rigidly fixed to steering sleeve 30 (i.e., fixed relative to steering sleeve 30) and positioned to receive flow deflected by reversing vane 32. Steering sleeve 30 is pivotably mounted about a substantially vertical axis to aft portion 16 of vehicle hull 12 aft of nozzle 28 for receiving accelerated flow subsequent to the flow exiting nozzle 28. Thus, steering and reversing gear 10 is mounted to hull 12 independent of nozzle 28, pump 22, and remaining structure of waterjet propulsion system 14.

Figure 2:
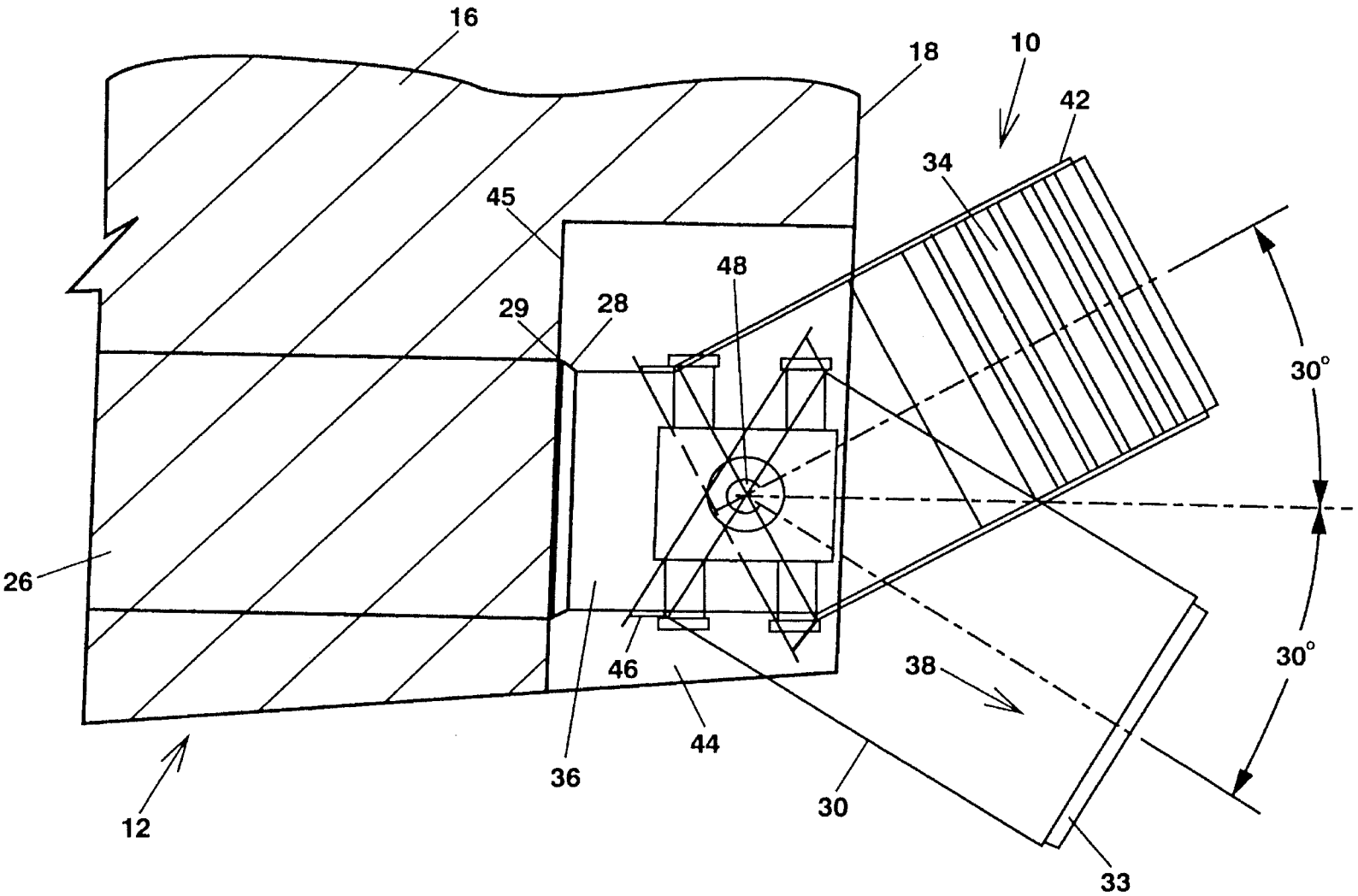
FIG. 2 is a plan view of the steering and reversing gear of the present invention showing a single steering and reversing gear at port and starboard extremes of pivotal motion.
Figure 3:
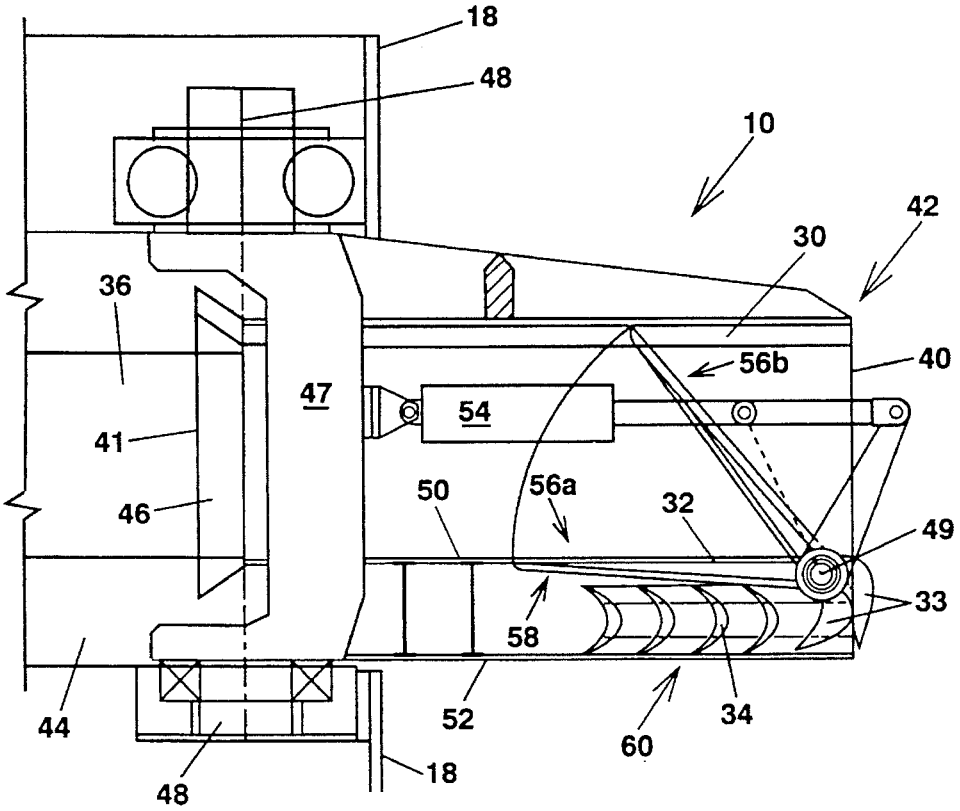
FIG. 3 is a side view of the steering and reversing gear of the present invention.
Figure 4:
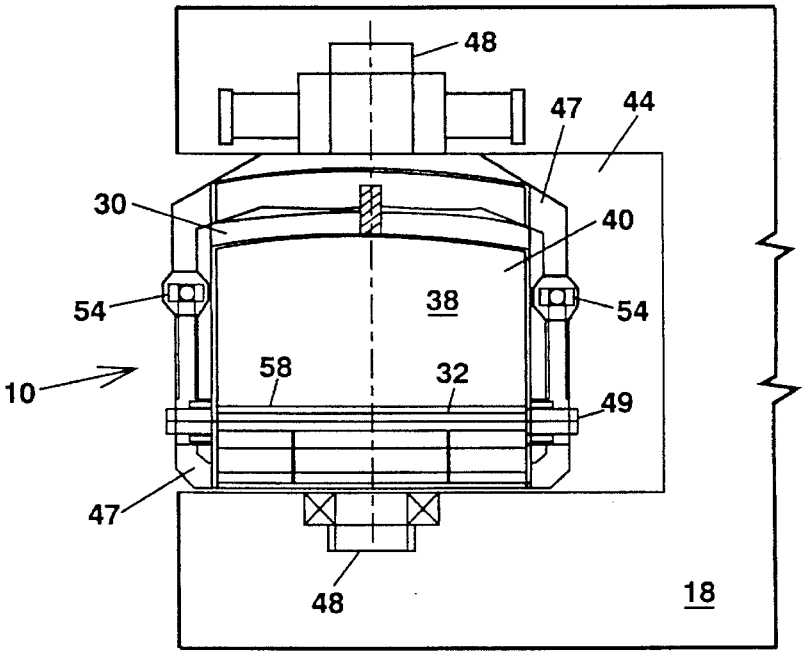
FIG. 4 is a back view of the steering and reversing gear of the present invention.

Referring to FIGS. 2–4, details of a preferred embodiment of the present invention are shown. Steering and reversing gear 10 receives a flow 36 from outlet nozzle 28 and functions to redirect flow 36 (preferably a free jet flow) so as to provide maneuvering capability to the vehicle. Thus, steering and reversing gear 10 deflects flow 36 subsequent to its leaving nozzle 28 and, consequently, nozzle 28 may remain stationary.

Steering and reversing gear 10 generally includes steering sleeve 30 defining flow passage 38 having rearwardly facing outlet 40 and at least one pivotal reversing vane 32 pivotably mounted to aft end 42 of sleeve 30. Hollow steering sleeve 30, which is placed behind nozzle 28, is sized to receive at least a major portion of free jet flow 36 from nozzle 28. That is, flow passage 38 of sleeve 30 has an inlet 41 having an internal dimension which is equal to or greater than the internal dimension of nozzle 28. In a preferred embodiment, a plurality of stationary curved vanes 34 are rigidly mounted to the bottom of sleeve 30 below reversing vane 32 to deflect water leaving pivotal reversing vane 32. Steering sleeve 30, which is a nozzle or tube, preferably nominally a substantially square or rectangular tube, for deflecting free jet flow 36 received from outlet nozzle 28 from side-to-side, is pivotably mounted about a substantially vertical axis to aft portion 16 of hull 12. Gear 10 may be pivotably mounted directly to the surface of hull 12 at transom stern 18 or may be pivotably mounted to hull 12 in watertight recess 44 (also referred to as cut-out 44) in aft portion 16 of hull 12. In a preferred embodiment, gear 10 is located at or only slightly above the waterline. If mounted in cut-out 44, gear 10 is pivotable approximately 30° to port and starboard from a substantially longitudinally oriented position.

To allow pump 22 and nozzle 28 to be fitted further forward, and thus enable a more favorable longitudinal center of gravity (LCG) position, a deep hull recess or cut-out 44 and a free jet 36 may be used. Nozzle 28 will be mounted in hull 12 such that nozzle 28 discharges accelerated flow through aperture 29 in forward bulkhead 45 of hull cut-out 44. The longitudinal depth of cut-out 44, from forward bulkhead 45 of cut-out 44 to transom stern 18, should allow free jet 36 to have a length of less than 1.5 times the jet equivalent diameter, and preferable about one equivalent jet diameter, before entry into steering sleeve 30. This should prevent the jet surface from peeling off and forming a heavy spray and thus insure a solid jet entirely entering the sleeve 30. By including free jet 36, the length of flow duct 26 can be shortened resulting in reduced internal duct losses. For simplicity, the longitudinal depth of cut-out 44, from transom stern 18 to forward bulkhead 45 of cut-out 44, should be less than about 1.5 times the lateral dimension of flow passage 38.

As stated earlier, prior art waterjet propulsors for which steering and reversing capability is provided by the waterjet propulsor itself (rather than for example rudders) have the steering and reversing gear attached directly to the waterjet pump or outlet nozzle. Thus, the waterjet system provides structural support to the steering and reversing gear which, in turn, transmits large maneuvering forces and moments to the system. Furthermore, the weight of the steering and reversing gear produces additional stress on the system. In the present invention, steering and reversing gear 10 is mounted to hull 12 completely independent of nozzle 28. Consequently, the weight of gear 10 and the steering and reversing forces produced by it are not supported by waterjet propulsion system 14 but are transmitted directly to hull 12 thus allowing waterjet propulsion system 14 to be smaller and lighter than if the steering and reversing mechanism were mounted to and supported by the pump or nozzle.

Nozzle 28 directs flow 36 into sleeve 30 of gear 10 which deflects the jet laterally to provide directional control to the vehicle. Sleeve 30 is made somewhat larger than waterjet nozzle 28, particularly in the lateral direction, such that it captures the entirety of flow 36 leaving nozzle 28 at all pivot angles of gear 10. In a preferred embodiment, steering sleeve 30 includes outwardly angled flange 46 at its forward end. Flange 46 is angled to align with the sides of free jet flow 36 at the extremes of steering motion. That is, the width and angle of angled flange 46 of steerable sleeve 30 are determined such that the port side of angled flange 46 will be approximately parallel with one lateral side of free jet flow 36 when sleeve 30 is fully rotated to port (i.e., rotated clockwise when looking down onto sleeve 30) and the starboard side of angled flange 46 will be approximately parallel with the opposite lateral side of free jet flow 36 when sleeve 30 is fully rotated to starboard. Therefore, sleeve 30 will capture substantially the entirety of free jet flow 36 regardless of the angle at which sleeve 30 is positioned.

steering sleeve 30 is supported by a yoke 47 that is pivoted in the hull on substantially horizontal pivot shaft or spindles 48 (either a single shaft or short upper and lower spindle shafts) and is, in turn, supported by bearings, e.g., pedestal bearings at the bottom and bearings integral with the steering actuator at the top. Thus, waterjet stream 36 may be redirected by rotation of the sleeve 30 on short shafts 48, at will, in the lateral direction. The use of short shafts 48 and bearings for attachment of sleeve 30 directly to vessel hull 12 allows an extremely strong support for steerable sleeve 30 with relatively little weight. By the same token, loads on steerable sleeve 30 are transmitted directly to vessel hull 12 through the bearings and there is no mechanical connection of steerable sleeve 30 to nozzle 28 or pump 22. The relative sizing of the nozzle 28 and steerable sleeve 30 is not critical and different nozzles and/or pumps may be installed and will operate identically as long as waterjet stream 36 from nozzle 28 can be captured by sleeve 30. In other words, redesign or change of propulsor pump 22 and/or nozzle 28 does not require corresponding changes in steering and reversing gear 10 or even, in most cases, modification of hull cut-outs 44.

Because steering and reversing gear 10 is pivotably mounted about a substantially vertical axis to aft portion 16 of hull 12 it may be rotated about its axis in the same way as conventional rudders using conventional, well-known steering machinery with the rudder post replaced by steering sleeve spindles 48. As an example, steering sleeve 10 may pivot about pivot shaft or spindles 48 and upper and lower bearing mounts which are fitted with watertight seals. Pivot shaft 48 may penetrate either or both of the upper and lower bearing mounts into hull 12 where one or both are connected to steering gear actuators. Steering actuation may be executed, for example, by means of a bell-crank and double actuating hydraulic cylinder, or by a rack-and-pinion gear type of linear actuator driven by an electric or hydraulic motor.

Steering sleeve 30 preferably has a double bottom to protect stationary cascade vanes 34 which are rigidly attached to sleeve 30 between inner bottom 50 and outer bottom 52. Inner bottom 50 and outer bottom 52 have apertures (58 and 60) therethrough to allow flow through cascade vanes 34. This arrangement creates a very rigid box structure. Forward of cascade vanes 34, inner bottom 50 may be supported by webs. The top of sleeve 30 is preferably bowed in the transverse direction to reduce stress and is further strengthened by a beam cantilevered from yoke 47.

Reversing vane 32 is preferably a flat vane pivotably mounted on substantially horizontal shaft or spindle 49 to aft end 42 of sleeve 30. A flat vane is considered preferable to a cambered vane since a flat vane does not restrict flow passage 38 during normal operation and does not abruptly change the amount of water deflected when the angle of the vane causes it to stall. Reversing vane 32 may further include curved vane portion 33 depending from its aft end. For normal ahead operation, when reverse thrust is not required, reversing vane 32 lies flat in sleeve 30 along inner bottom 50 just above cascade vanes 34 thus providing all or a part of the bottom wall or surface of flow passage 38. In this position, reversing vane 32 does not interfere with flow through sleeve 30. When partial, or full, reverse-thrust operation is required, reversing vane 32 may be rotated, for example, by double-acting hydraulic actuators 54 on each side of sleeve 30, which are anchored to yoke 47, and which raise the reversing vane through bell cranks. Reversing vane actuator system 54 may be mounted externally of sleeve 30 or may be surrounded by a protective fairing that also encases sleeve 30. As reversing vane 32 pivots from substantially horizontal, fully opened position **56*a* (i.e., flow passage 38 fully opened) to fully closed positions 56*b* (i.e., flow passage 38 fully closed), it creates aperture 58 in inner bottom 50 (inner bottom 50 acts as the bottom surface of flow passage 38). At the same time its forward edge engages the jet flow, thus, deflecting part or all of the flow downward through aperture 58 to provide stopping and reversing thrust. When reversing vane 32 is at maximum pivot 56*b*, its forward edge rests against the top edge of sleeve 30 closing off flow passage 38** and diverting virtually all of the flow, thus providing maximum reverse thrust.

Plurality of curved cascade vanes 34 are rigidly mounted in the bottom of the sleeve 30 in or just below aperture 58. Cascade vanes 34 are, thus, stationary relative to rotatable steering sleeve 30. Preferably, plurality of curved cascade vanes 34 are mounted lateral to and integral with sleeve 30 below reversing vane 32, in the area of aperture 58 opened by the pivoting of reversing vane 32, for receiving flow deflected by reversing vane 32 and redirecting the flow in a generally downward and forward direction to provide additional turning of the jet flow directed by reversing vane 32 through aperture 58. This curved vane structure has the advantage of being structurally rigid and can be used to stiffen the structure of the steerable sleeve 30. Further, the plurality of curved vanes 34 has much the same hydrodynamic properties as a multiply slotted airfoil and is very efficient in forming a coherent jet at a reversed angle. If desired, reversing vane 32 may have a curved portion 33, which follows the curvature of the plurality of curved vanes 34 when reversing vane 32 is fully deployed, to intercept a portion of the waterjet flow. The angle of the deflected waterjet emanating therefrom can also be made to more nearly reverse the direction of the intercepted portion of the waterjet and a higher level of reverse thrust can be obtained. Additionally, the plurality of curved vanes 34 does not change position when reverse thrust is employed and is largely protected from damage due to contact with submerged objects by outer bottom 52.

It should be appreciated that since reversing vane 32 turns with steerable sleeve 30, angled thrust can be achieved in either forward or reverse thrust mode of operation and improved maneuverability is thus achieved. Forward and reverse thrust can be balanced, as with known reversing bucket designs, by movement of reversing vane 32 to a position approximately half way between fully opened and fully closed positions **56*a* and 56*b*, respectively. Full reverse thrust is obtained, as before, when flow passage 38 of sleeve 30 is effectively closed by movement of vane 32 to fully closed position 56*b*. Since the plurality of curved cascade vanes 34 are fixed relative to sleeve 30, no control rods to move cascade vanes 34** need be provided.

The following example presents dimensions that indicate the size of the steering and reversing gear when applied to a waterjet propulsor having a 50,000 hp (37,285 kW) nominal rating designed for high propulsive efficiency at about 30 knots (assuming a pump efficiency of 90%).

| Design Data for a 50,000 hp (37,285 kW) Propulsor | |
|---|---|
| Nozzle Area | 62.5 $ft^2$ (5.8 $m^2$) |
| Nozzle Equivalent Diameter | 8.9 ft (2.7 m) |
| Jet Velocity | 81.5 ft/s (24.84 m/s) |
| Steering Angle | ±30° |
| Pump Flow Rate | 5094 $ft^3$/s (144.2 $m^3$/s) |
| Mass Flow Rate | 145.5 tons/s (147,846 kq/s) |
| Gross Thrust | 825,650 lbf (3672.5 kN) |
| Net Thrust | 312,725 lbf (1391 kN) |
| Maximum Side Force | 392,310 lbf (1745 kN) |
| Reverse Thrust (static) | 206,385 lbf (918 kN) |
| Braking Force | 925,965 lbf (4118.7 kN) |

Using the data presented in the above table, the following loads on this particular embodiment of the invention can be obtained. The net force on the sleeve, which is the vector sum of the side force and the change of thrust parallel to the ships centerline, is 496,855 lbf (2210 kN). This force will produce a turning moment about the pivot point, depending on its line of action. If the reaction of the sleeve acts at a distance of 8.2 ft (2.5 m) from the pivot axis, i.e., about halfway down the sleeve, the torque required of the steering actuator is 4,075,235 ft-lbf (5525 kN-m). The reversing vane experiences a horizontal force equal to the sum of the forward gross thrust and the reverse thrust generated by the reversing gear. Thus, the total horizontal thrust on the reversing vane is 1,238,760 lbf (5510 kN). In addition there is a vertical force due to downward deflection of the jet about 60 degrees to the horizontal. Neglecting vane losses for a first approximation, the vertical force is 715,155 lbf (3181 kN). Thus, the reversing vane experiences a resultant force of 1,430,305 lbf (6362 kN) acting at an angle to the horizontal of about 30°.

Preliminary weight calculations for this preferred embodiment of the present invention, i.e., steering and reversing gear for use with a 50,000 hp (37,285 kW) propulsor are as follows:

| | | |
|---|---|---|
| Steering Sleeve (1) | 56,000 lb | (25,401 kg) |
| Cascade Vanes (4) | 16,100 lb | (7,303 kg) |
| Reversing Vane (1) | 18,900 lb | (8,573 kg) |
| Reversing Vane Shaft (1) | 1,500 lb | (680 kg) |
| Reversing Vane Levers (2) | 2,000 lb | (907 kg) |
| Reversing Vane Actuators (2) | 8,400 lb | (3,810 kg) |
| Yoke and Pivots (1 set) | 22,000 lb | (9,979 kg) |
| Lower Bearing Assembly (1) | 12,000 lb | (5,443 kg) |
| Upper Bearing Assembly (1) | 5,000 lb | (2,268 kg) |
| Steering Actuator (1) | 66,000 lb | (29,937 kg) |
| Controls/Misc. Hardware | 3,500 lb | (1,588 kg) |
| Total Weight 94.4 LT = | 211,400 lb | (95,889 kg) |

The principal advantages of the hull-mounted steering and reversing gear for very large waterjets include the following:

(1) All steering and reversing forces are transmitted directly into the hull structure instead of through the pump body and pump attachments to the hull.

(2) The stresses associated with the steering and reversing forces at the hull-attachment points of the steering and reversing gear can be much lower than for pump attachment points since the pivot bearings and their foundations can be made much larger than would be possible on a pump body.

(3) The pump design is not compromised by the necessity to support the very heavy weight and large forces associated with steering and reversing gear. Thus, the pump can be lighter.

(4) The pump is entirely enclosed within the hull where it is protected and is accessible for maintenance and repair.

(5) If necessary, the pump can be removed, and replaced (possibly with a pump of different make, model and size providing that the nozzle of the new pump is not significantly larger), without disturbing the steering and reversing gear. Conversely, the steering and reversing gear can be removed, and replaced, without disturbing the pump, the waterjet inlet, or the drive train.

(6) The entire drive train, including the pump, inlet, couplings, foundations and mounts, transmission, and engine, are protected from results of accidental collision at the stern.

(7) Because of the hull cut-outs, the steering and reversing gear is more accessible for service and repair than if it were attached to the pump outside the hull.

(8) The steering actuator is fully protected within the hull.

(9) The reversing gear can be fully or partially enclosed within the sidewalls of the steering sleeve. Alternatively, the hydraulic cylinder rams may be enclosed in expanding stainless steel or rubber sleeves to prevent seawater corrosion or marine growth.

(10) Conventional rudder actuators and/or steering machinery can be used, as used in propeller driven ship designs, with the steering sleeve spindle of present invention replacing the rudder post of the propeller driven design.

(11) Total propulsor weight will be reduced compared to pump mounted steering and reversing gear systems having similar sized nozzles.

(12) All the principal advantages of steering and reversing gear are retained.

a) Steering is positive and always in the correct sense, i.e., wheel to port results in turn to port, etc.

b) Steering and reversing are combined.

c) There is a null point where reverse thrust and forward thrust are balanced.

d) For a crash stop, full reverse may be applied at full forward speed.

e) Excellent ship maneuverability compared with propeller/rudder combinations.

(13) To clear the stern, reverse flow can be directed outboard as well as downward and forward, through the use of supplementary cascade vanes or by inclined orientation of the steering sleeve pivot axis in the hull.

(14) Contrary to existing pump-supported designs, there appears to be no limit to the size of the present steering and reversing gear, i.e., it could accommodate the highest horsepower per shaft of any existing or foreseeable waterjet propelled ship design.

In view of the foregoing, it is readily appreciated that the steering and reversing gear in accordance with the present invention is highly suited to use with very high power waterjet propulsion systems installed on large ocean-going vessels such as, for example, Naval Destroyers. By mounting the pump, and the motive power system to drive it, stationary in the hull and by achieving manipulation of the waterjet by means of vanes in combination with a movable sleeve mounted to the vessel hull rather than to the pump or pump nozzle, great savings in weight can be achieved and the propulsor can be fully integrated into the vessel design for efficiency. Further, simple and powerful actuators, such as are presently used on large marine vessels for actuating the rudders, may be used for moving the sleeve and movable vanes and can readily be positioned within the hull where they will be free from damage due to flow or collision, will not increase hull resistance and may be easily maintained.

While the invention has been described in terms of a single preferred embodiment, those skilled in the art will recognize that the invention can be practiced with modification within the spirit and scope of the appended claims.

What is claimed is:

1. An apparatus for receiving flow discharged from a fixed nozzle of a waterjet propulsion system, the nozzle directing the flow in a generally aft direction for propelling a vessel through water, said apparatus acting to redirect the flow received from the nozzle for providing maneuvering capability to the vessel, said apparatus comprising:

a hollow steering sleeve defining a flow passage, said flow passage having a lateral dimension associated therewith, said steering sleeve adapted to be pivotably mounted about a substantially vertical axis directly to a stern of the vessel independent of the nozzle, said steering sleeve being longitudinally separated from the nozzle so as to allow the flow discharged from the nozzle to form a free jet flow before entering said steering sleeve, said longitudinal separation being less than about 1.5 times said lateral dimension of said flow passage, said flow passage having an inlet with an internal dimension equal to or greater than an internal dimension of the nozzle, said flow passage having a rearwardly facing outlet, said flow passage from said inlet to said outlet being in axial alignment with the nozzle to receive at least a major portion of the free jet flow subsequent to the free jet flow exiting the nozzle, said steering sleeve further including an outwardly angled flange depending from a forward end of said steering sleeve and projecting towards said nozzle, said flange being angled to align with lateral sides of the free jet flow at port and starboard extremes of pivotal motion of said steering sleeve, wherein an angle of said angled flange is determined such that a port side of said angled flange is approximately parallel with a port lateral side of the free jet flow when said steering sleeve is fully rotated to port and a starboard side of said angled flange is approximately parallel with a starboard lateral side of the free jet flow when said steering sleeve is fully rotated to starboard; and at least one reversing vane pivotably mounted to said steering sleeve and positioned entirely within said flow passage, said at least one reversing vane pivotal between a first substantially horizontal position wherein said at least one reversing vane functions as at least a portion of a bottom surface of said flow passage, and a second position wherein said at least one reversing vane closes said rearwardly facing outlet and defines an aperture in said bottom surface of said flow passage, the flow being deflected by said at least one reversing vane to an exterior of said steering sleeve through said aperture, wherein said apparatus acts independently of the nozzle to redirect the flow received from the nozzle such that forces acting on said apparatus are transmitted directly to the vessel with none of said forces being transmitted to the waterjet propulsion system.

2. An apparatus as recited in claim 1 further including a plurality of curved vanes, said plurality of curved vanes rigidly mounted laterally to and integral with said steering sleeve so as to be stationary relative to said steering sleeve, said plurality of curved vanes positioned below said at least one reversing vane for receiving flow deflected by said at least one reversing vane through said aperture and redirecting the flow in a generally downward and forward direction.

3. An apparatus as recited in claim 1 wherein said steering sleeve includes an inner bottom and outer bottom, said plurality of curved vanes being rigidly attached to said steering sleeve between said inner bottom and said outer bottom, said inner bottom and said outer bottom have apertures therethrough substantially vertically aligned with said plurality of curved vanes to allow flow deflected by said at least one reversing vane to pass through said plurality of curved vanes to an exterior of said steering sleeve.

4. An apparatus as recited in claim 1 further comprising a mounting means for mounting said steering sleeve to the stern of the vessel such that said steering sleeve pivots approximately 30 degrees to port and starboard relative to a longitudinal centerline of the vessel, said mounting means including an exterior yoke coupled to said steering sleeve and to upper and lower spindles, said upper and lower spindles adapted to be pivotably mounted to the interior of the vessel and to penetrate the vessel for coupling with said exterior yoke, at least said upper spindle adapted for coupling with a first actuator internal to the vessel for pivoting said steering sleeve, said apparatus further comprising at least a second actuator for pivoting said at least one reversing vane between said first and second positions, said at least one reversing vane being mounted to a substantially horizontal pivot shaft, said second actuator being anchored at a first end to said yoke and at a second end to said pivot shaft.

5. A waterjet propulsion system for propelling a large ocean-going vessel, said waterjet propulsion system including a pump means mounted in a stationary fashion within the vessel for providing a waterjet flow;

a nozzle rigidly mounted to and penetrating a stern of the vessel, said nozzle in flow communication with said pump means for discharging said flow to an exterior of the vessel;

a hollow steering sleeve defining a flow passage, said flow passage having a lateral dimension associated therewith, said steering sleeve adapted to be pivotably mounted about a substantially vertical axis directly to the stem of the vessel independent of said nozzle, said steering sleeve being longitudinally separated from said nozzle so as to allow said flow discharged from said nozzle to form a free jet flow before entering said steering sleeve, said longitudinal separation being less than about 1.5 times said lateral dimension of said flow passage said flow passage having an inlet with an internal dimension equal to or greater than an internal dimension of said nozzle, said flow passage having a rearwardly facing outlet, said flow passage from said inlet to said outlet being in axial alignment with said nozzle to receive at least a major portion of said free jet flow subsequent to said free jet flow being discharged from said nozzle, said steering sleeve further including an outwardly angled flange depending from a forward end of said steering sleeve and projecting towards said nozzle, said flange being angled to align with lateral sides of said free jet flow at port and starboard extremes of pivotal motion of said steering sleeve, wherein an angle of said angled flange is determined such that a port side of said angled flange is approximately parallel with a port lateral side of said free jet flow when said steering sleeve is fully rotated to port and a starboard side of said angled flange is approximately parallel with a starboard lateral side of said free jet flow when said steering sleeve is fully rotated to starboard; and at least one reversing vane pivotably mounted to said steering sleeve and positioned entirely within said flow passage, said at least one reversing vane pivotal between a first substantially horizontal position wherein said at least one reversing vane functions as at least a portion of a bottom surface of said flow passage, and a second position wherein said at least one reversing vane closes said rearwardly facing outlet and defines an aperture in said bottom surface of said flow passage, the flow being deflected by said at least one reversing vane to an exterior of said steering sleeve through said aperture, wherein said steering sleeve acts independently of said nozzle to redirect said flow received from said nozzle such that forces acting on said steering sleeve are transmitted directly to the vessel with none of said forces being transmitted to said pump or nozzle.

6. A waterjet propulsion system as recited in claim 5 further including a plurality of curved vanes, said plurality of curved vanes rigidly mounted laterally to and integral with said steering sleeve so as to be stationary relative to said Steering sleeve, said plurality of curved vanes positioned below said at least one reversing vane for receiving flow deflected by said at least one reversing vane through said aperture and redirecting the flow in a generally downward and forward direction.

7. A waterjet propulsion system as recited in claim 6 wherein said steering sleeve includes an inner bottom and outer bottom, said plurality of curved vanes being rigidly attached to said steering sleeve between said inner bottom and said outer bottom, said inner bottom and said outer bottom have apertures therethrough substantially vertically aligned with said plurality of curved vanes to allow flow deflected by said at least one reversing vane to pass through said plurality of curved vanes to an exterior of said steering sleeve.

8. A waterjet propulsion system as recited in claim 7 further comprising a mounting means for mounting said steering sleeve to the stern of the vessel such that said steering sleeve pivots approximately 30 degrees to port and starboard relative to a longitudinal centerline of the vessel, said mounting means including an exterior yoke coupled to said steering sleeve and to upper and lower spindles, said upper and lower spindles adapted to be pivotably mounted to the interior of the vessel and to penetrate the vessel for coupling with said exterior yoke, at least said upper spindle adapted for coupling with a first actuator for pivoting said steering sleeve, said apparatus further comprising at least a second actuator for pivoting said at least one reversing vane between said first and second positions, said at least one reversing vane being mounted to a substantially horizontal pivot shaft, said second actuator being anchored at a first end to said yoke and at a second end to said pivot shaft.

9. A vessel having a high power waterjet propulsion system including:

a hull means;

at least one pump means mounted in a stationary fashion within said hull means for providing a waterjet flow, said at least one pump means producing at least about 27,000 hp (20 mW) of propulsion power;

at least one nozzle wherein said at least one nozzle is associated with a corresponding one of said at least one pump means, said at least one nozzle rigidly mounted to and penetrating a stern of said hull means, said at least one nozzle in flow communication with said corresponding pump means for discharging said flow to an exterior of said hull means;

at least one hollow steering sleeve wherein said at least one steering sleeve is associated with a corresponding one of said at least one nozzle, said at least one steering sleeve defining a flow passage having an inlet with an internal dimension equal to or greater than an internal dimension of said corresponding nozzle and having a rearwardly facing outlet, said flow passage being in axial alignment with said corresponding nozzle to receive at least a major portion of said flow subsequent to said flow being discharged from said corresponding nozzle, said at least one steering sleeve adapted to be pivotably mounted about a substantially vertical axis directly to said stern of said hull means independent of said corresponding nozzle, said at least one steering sleeve being longitudinally, separated from said corresponding nozzle so as to allow said flow discharged from said nozzle to form a free jet flow before entering said steering sleeve, said at least one flow passage having a lateral dimension associated therewith wherein said longitudinal separation is less than about 1.5 times said lateral dimension, said at least one steering sleeve further including an outwardly angled flange depending from a forward end of said at least one steering sleeve and projecting towards said corresponding nozzle, said flange being angled to align with lateral sides of said free jet flow at port and starboard extremes of pivotal motion of said at least one steering sleeve, wherein an angle of said angled flange is determined such that a port side of said angled flange is approximately parallel with a port lateral side of said free jet flow when said at least one steering sleeve is fully rotated to port and a starboard side of said angled flange is approximately parallel with a starboard lateral side of said free jet flow when said at least one steering sleeve is fully rotated to starboard; and at least one reversing vane wherein said at least one reversing vane is associated with a corresponding one of said at least one steering sleeve, said at least one reversing vane pivotably mounted to said corresponding steering sleeve and positioned entirely within said flow passage, said at least one reversing vane pivotal between a first substantially horizontal position wherein said at least one reversing vane functions as at least a portion of a bottom surface of said flow passage, and a second position wherein said at least one reversing vane closes said rearwardly facing outlet and defines an aperture in said bottom surface of said flow passage, the flow being deflected by said at least one reversing vane to an exterior of said corresponding steering sleeve through said aperture, wherein said at least one steering sleeve acts independently of said corresponding nozzle to redirect said flow received from said corresponding nozzle such that forces acting on said at least one steering sleeve are transmitted directly to said hull means with none of said forces being transmitted to said corresponding pump or nozzle.

10. A vessel as recited in claim 9 wherein said at least one steering sleeve further includes a plurality of curved vanes, said plurality of curved vanes rigidly mounted laterally to and integral with said at least one steering sleeve so as to be stationary relative to said at least one steering sleeve, said plurality of curved vanes positioned below said corresponding reversing vane for receiving said flow deflected by said reversing vane through said aperture and redirecting said flow in a generally downward and forward direction.

11. A vessel as recited in claim 10 wherein said hull means includes at said stern thereof at least one watertight recess projecting forward from said stern, wherein said at least one watertight recess is associated with a corresponding one of said at least one nozzle, said corresponding nozzle opening into said recess through an aperture in a forward bulkhead of said recess, and further wherein said at least one steering sleeve is pivotably mounted within a corresponding recess, said at least one recess dimensioned to allow said corresponding Steering sleeve to pivot approximately 30 degrees to port and starboard relative to a longitudinal centerline of said vessel.

12. A vessel as recited in claim 11 wherein said at least one steering sleeve includes an inner bottom and outer bottom, said plurality of curved vanes being rigidly attached to said at least one steering sleeve between said inner bottom and said outer bottom, said inner bottom and said outer bottom have apertures therethrough substantially vertically aligned with said plurality of curved vanes to allow flow deflected by said at least one reversing vane to pass through said plurality of curved vanes to an exterior of said at least one steering sleeve.

13. A vessel as recited in claim 12 further comprising at least one mounting means wherein said at least one mounting means is associated with a corresponding one of said at least one steering sleeve for mounting said corresponding steering sleeve in said corresponding recess such that said steering sleeve pivots approximately 30 degrees to port and starboard relative to a longitudinal centerline of said vessel, said at least one mounting means including an exterior yoke coupled to said corresponding steering sleeve and to upper and lower spindles, said upper and lower spindles pivotably mounted to an interior of said hull means, said upper and lower spindles penetrating said hull means into said corresponding recess for coupling with said exterior yoke, at least said upper spindle coupled with a first actuator for pivoting said corresponding steering sleeve, said vessel further comprising at least a second actuator associated with a corresponding one of said at least one reversing vane for pivoting said corresponding reversing vane between said first and second positions, said reversing vane being mounted to a substantially horizontal pivot shaft, said second actuator being anchored at a first end to said yoke and at a second end to said pivot shaft.

* * * * *